US005369810A

United States Patent [19]

Warren

[11] Patent Number: 5,369,810

[45] Date of Patent: Dec. 6, 1994

[54] MALODOROUS AIR ENTRAPMENT APPARATUS

[76] Inventor: H. Ray Warren, 15 Sunrise Trail, Medford, N.J. 08055

[21] Appl. No.: 985,801

[22] Filed: Dec. 2, 1992

[51] Int. Cl.[5] ..... E03D 9/052

[52] U.S. Cl. ..... 4/213

[58] Field of Search ..... 4/213, 217

[56] References Cited

U.S. PATENT DOCUMENTS

| | | | |
|---|---|---|---|
| 2,100,962 | 11/1937 | Juntunen | 4/213 |
| 2,105,794 | 1/1938 | Norris | 4/213 |
| 2,227,920 | 1/1941 | Baither | 4/213 |
| 2,279,789 | 4/1942 | Jentzer | 4/213 |
| 2,881,450 | 4/1959 | Tubbs | 4/67 |
| 2,983,890 | 5/1961 | Baither | 4/213 |
| 3,087,168 | 4/1963 | Huso | 4/213 |
| 3,691,568 | 9/1972 | Martz | 4/213 |
| 3,740,772 | 6/1973 | Paley | 4/217 |
| 3,763,505 | 10/1973 | Zimmerman | 4/213 |
| 3,781,923 | 1/1974 | Maisch et al. | 4/213 |
| 3,887,948 | 6/1975 | Stamper | 4/213 |
| 4,031,574 | 6/1977 | Werner | 4/213 |
| 4,094,023 | 6/1978 | Smith | 4/213 |
| 4,153,956 | 5/1979 | Fischer | 4/213 |
| 4,165,554 | 8/1979 | Barry | 4/213 |
| 4,166,298 | 9/1979 | Pearson | 4/213 |
| 4,175,293 | 11/1979 | Stephens | 4/209 |
| 4,317,242 | 3/1982 | Stamper | 4/213 |
| 4,318,192 | 3/1982 | Williams et al. | 4/213 |
| 4,583,250 | 4/1986 | Valarao | 4/213 |
| 4,590,629 | 5/1986 | Lask | 4/213 |
| 4,726,078 | 2/1988 | Carballo et al. | 4/213 |
| 5,054,130 | 10/1991 | Wilson | 4/213 |
| 5,125,119 | 6/1992 | Munoz | 4/213 |
| 5,167,039 | 12/1992 | Sim | 4/216 |

*Primary Examiner*—Charles E. Phillips

[57] ABSTRACT

Apparatus disposed inside the flushing tank of a toilet for drawing and entrapping malodorous elements of air from the bowl of a bathroom commode. The malodorous air is drawn from the bowl through the flushing tank overflow pipe, and forced through an easily replaceable cartridge which contains a battery and a malodorous air entrapping chamber. By the location of a portion the housing and air passage-way below the water line of the flushing tank, filter and battery size are increased for longer filter and battery life.

The low pressure air seal provided by the water residing between a pipe of larger diameter than the diameter of the overflow pipe has a length sufficient to permit the low pressure air seal to form at the beginning of the refilling cycle, thus shortening the functional recovery time after flushing.

An air duct with an adjustable portion provides adaptability to different commode tank designs.

5 Claims, 6 Drawing Sheets

MALODOROUS AIR ENTRAPMENT APPARATUS

BACKGROUND AND DESCRIPTION OF PRIOR ART

One of the several methods of removing malodorous elements of air from bathrooms is the use of exhaust fans. Fans, mounted on a wall or in the ceiling, vents malodorous bathroom air to the outside environment. During the exhaust period however, the migration of malodorous air throughout the bathroom becomes unpleasant to both the current and subsequent bathroom users.

In some prior art devices, such as in U.S. Pat. No. 2,227,920 issued January 1941 to Baither, the odor removal device is not an attachment, rather, it is an integral part of the design of the commode, and thus it is not suitable as an attachment to a commode of a different design.

In other prior art devices, alteration of the bathroom wall is required so that the malodorous air can be vented directly from the bowl to the atmosphere through an air duct. Examples of such devices are described in:

U.S. Pat. No. 2,100,962 issued, Nov. 19, 1937 to Juntunen;

U.S. Pat. No. 2,105,794 issued January, 1938 to Norris;

U.S. Pat. No. 2,279,789 issued April, 1942 to Jentzer;

U.S. Pat. No. 2,881,450 issued March, 1959 to Tubbs;

U.S. Pat. No. 4,165,544 issued August, 1979 to Barry;

U.S. Pat. No. 4,175,293 issued November, 1979 to Stephens;

U.S. Pat. No. 3,691,568 issued September, 1972 to Martz.

Large area, flat type charcoal filters are used in devices which are mounted on the top of existing flushing tanks such as described in:

U.S. Pat. No. 3,763,505, issued to Zimmerman, Oct. 9, 1973

U.S. Pat. No. 4,583,250, issued to Valarao, Apr. 22, 1986 and

U.S. Pat. No. 3,781,923 issued to Maisch, January, 1974.

Described in U.S. Pat. No. 4,590,629, issued May 27, 1986, to Lusk, is a pump for pumping air from a toilet bowl through a diffuser which is submerged in the flushing tank water. Since an under-water diffuser presents a higher impedance to air flow rate sufficiently high to overcome both the escaping, ascending, than a porous filter, higher air pressure is required; thus, a pump is appropriate. However, such a pump is also required to have an air flow rate sufficiently high to overcome both the escaping, ascending, air from the bowl and the leakage of air between the seat and the bowl. Contrary to the requirement of both high air pressure and high air flow rate, porous filter type malodorous air element removers require lower air pressure with the same air flow rate; thus, simple fans or blowers are adequate.

There are at least two requirements of the pump used in diffuser type devices:

1. The pump must be capable of providing sufficient pressure to:

(a) to expel the column of water disposed in the submerged is line 16, shown in FIG. 2 of U.S. Pat. No. 4,590,629, issued May 27, 1986, to Lusk, the required pressure being at least equal to the weight of water disposed in line 16, (b) to force the water through the relatively high impedance of the diffuser.

2. The pump must have an air-flow rate sufficiently high to:

(a) overcome the air leakage between the user and the seat, and, (b) overcome the leakage of ascending malodorous air from the bowl during and after the deposition of waste into the bowl.

Reference is made to vibrator type pumps, used for aerating small fish tanks. Pumps of this type can produce adequate pressure for the small air-flow rate required for small fish tanks; however, the low air-flow rate would result in the removal of an unacceptable amount of malodorous air from the bowl in the device described in the Lusk U.S. Pat. No. 4,590,629.

The above indicated combined requirements of air pressure, and the electrical power necessary to operate such a pump, is inconsistent with the use of a battery located inside the tank. A battery of acceptable size would have inadequate life; and alternatively, a battery with an acceptable life expectancy would be of a size unsuitable for mounting inside the tank; thus, AC line power, as suggested, would be used. However, the electrical shock hazard of using AC line power devices in the bathroom environment is well known. In the case of Lusk U.S. Pat. No. 4,590,629, the proximity of the AC motor to the ground potential of the flushing tank shown in the drawings, make the hazard evident and inconsistent with many building codes.

U.S. Pat. No. 4,726,078, issued Feb. 23, 1988, to Carballo, teaches a ventilating toilet seat which replaces the original seat. The replacement seat comprises a pre-filter for providing a scenting means for deodorizing noxious air. Air is extracted from the seat, through a tube or hose, by a separate fan or blower unit located adjacent to the toilet seat. Although devices of this type are attachable, the inconvenience and unsightliness of a hose attached to the seat, and the obstructive nature of the accompanying blower unit, are undesirable features.

Whether a seat-device mounted on the bowl, or a device attached to the top of the flushing tank, the attachment of these devices requires that the mating interfaces of the device and commode be such that a proper seal is maintained. The lack of an industry standard, for the shape and size of tanks and bowls, places a burden on the potential suppliers of such devices. A supplier of such devices would necessarily have the additional cost of designing, manufacturing and marketing many models of different sizes and shapes. This design of multiple products is necessary if the device is to be compatible with the majority of prevailing commode flushing tanks and seats.

A further undesirable feature of these add-on devices is their perceived intrusion into the bathroom. Their high visibility and their effect on the bathroom decor must also be a consideration in a potential product Some likely perceptions are that the height of the tank has been increased, or that there is a highly visible hose is attached to the seat, or that there is a highly visible line chord, of questionable safety, between the device and the electrical wall outlet. Another likely perception is that there is not an acceptable color match between the commode tank or bowl and the device. Color, as well as size and shape, is an important parameter in the visual acceptance of any bathroom device. In consideration of the many different colors of prevailing commodes, the matching of the color of the device with the color of the commode would be impractical. The cost to maintain a stock of the wide variety of the many different sizes, shapes and colors, required to match prevailing commode, renders these devices unfeasible with respect to cost, appearance, installation, serviceability and safety.

SUMMARY OF THE INVENTION

In the invention described herein, the malodorous air entrapping apparatuses is disposed inside the flushing tank of a toilet, and draws and entraps malodorous elements of air from the bowl of a bathroom commode. Malodorous air is removed from the bowl, through the flushing tank overflow pipe, through an air duct to the internally mounted housing of the device. Disposed in the main housing is a replaceable cartridge which comprises a filter, a battery, and means for electrical connections. As the air moves from the bowl through the filter, the malodorous elements of air are entrapped by the filter. The odor-free air is exhausted into the bathroom.

It is an objective of this invention to overcome such undesirable features as alterations to the bathroom walls, floor, ceiling or plumbing, and the intrusive perception of a visible addition to the bathroom. Simple installation, easy maintenance and low cost are further goals of this invention. A device which achieves these objectives is the invention disclosed herein.

The available space inside the tanks of prevailing designs is limited. However, the design of the majority of existing flushing tanks have a common internal space configuration. This invention teaches an malodorous air entrapping device disposed in the aforementioned commonly available space configuration in the flushing tank of bathroom commodes.

The device, in its operative location inside the flushing tank, draws malodorous air from the commode bowl through a plurality of rinsing or wash-down orifices of the bowl, through the overflow pipe and connecting air conduits, to the air intake of a fan or blower. The blower forces the malodorous air through the filter, after which, the odor-free air is exhausted into the bathroom through a small space between the tank and the tank cover.

It is therefore the objective of this invention to provide an malodorous air removal apparatus; that, by its residence within the tank, eliminates the problems of prior art device related to alterations, cost, installation, safety, serviceability and the requirement to match both the size and shape of the device with the size and shape of the tank.

It is an objective of this invention to provide a low cost bathroom malodorous air removal apparatus whose installation does not require alteration of either the commode or bathroom.

A further objective is to provide a device which is unobtrusive and does not require matching the size, shape or color of the device with the commode.

Another objective is to provide a device which can be installed without special skills or special tools.

Still another objective is to provide a device which, by the use of an internal, low voltage battery, overcomes the potential electrical hazard caused by the use of house current as a power source used in many prior art devices.

It is a further objective is to provide a device which is easily serviced by the simple replacement of a compact cartridge which contains both battery and filter.

Another objective of the invention is to provide a device which is easily mass produced and is of low cost.

Thus, in the practice of this invention, there is provided: a malodorous air removal apparatus disposed inside the commode flushing tank. As a result of today's concern of the conservation of water, heavier-than-water objects are placed in the tank to reduce the amount of water used to flush the commode. By the residence of the device in the tank, tank water is displaced in an amount equal to the submersed volume of the device, thus its residence inside the tank is consistent with water conservation.

The device comprises: a housing, a battery powered blower, a replaceable filter-battery cartridge and means for connecting the intake of the device to the overflow pipe. The arrangement of the components within the housing results in a size and configuration which permits its residence inside the flushing tank. The size and form factor are such that interference with the flushing apparatus of the commode is avoided.

Installation of the device is accomplished by removing the tank lid, flushing the commode, positioning the device within the tank, attaching the intake of the device to the overflow pipe and replacing the tank lid. A pipe of a larger diameter than the diameter of the overflow pipe, extends below the water level in the tank. The larger pipe provides the air intake means for a blower which forces air through a filtering chamber. The space between the inside diameter of the larger pipe and the outside diameter of the overflow pipe allows the overflow pipe to function normally, while the water residing between the larger diameter pipe and the overflow pipe provides a low pressure air seal therebetween. Connection is made between the larger diameter pipe and the air intake of the device.

Figure 1:
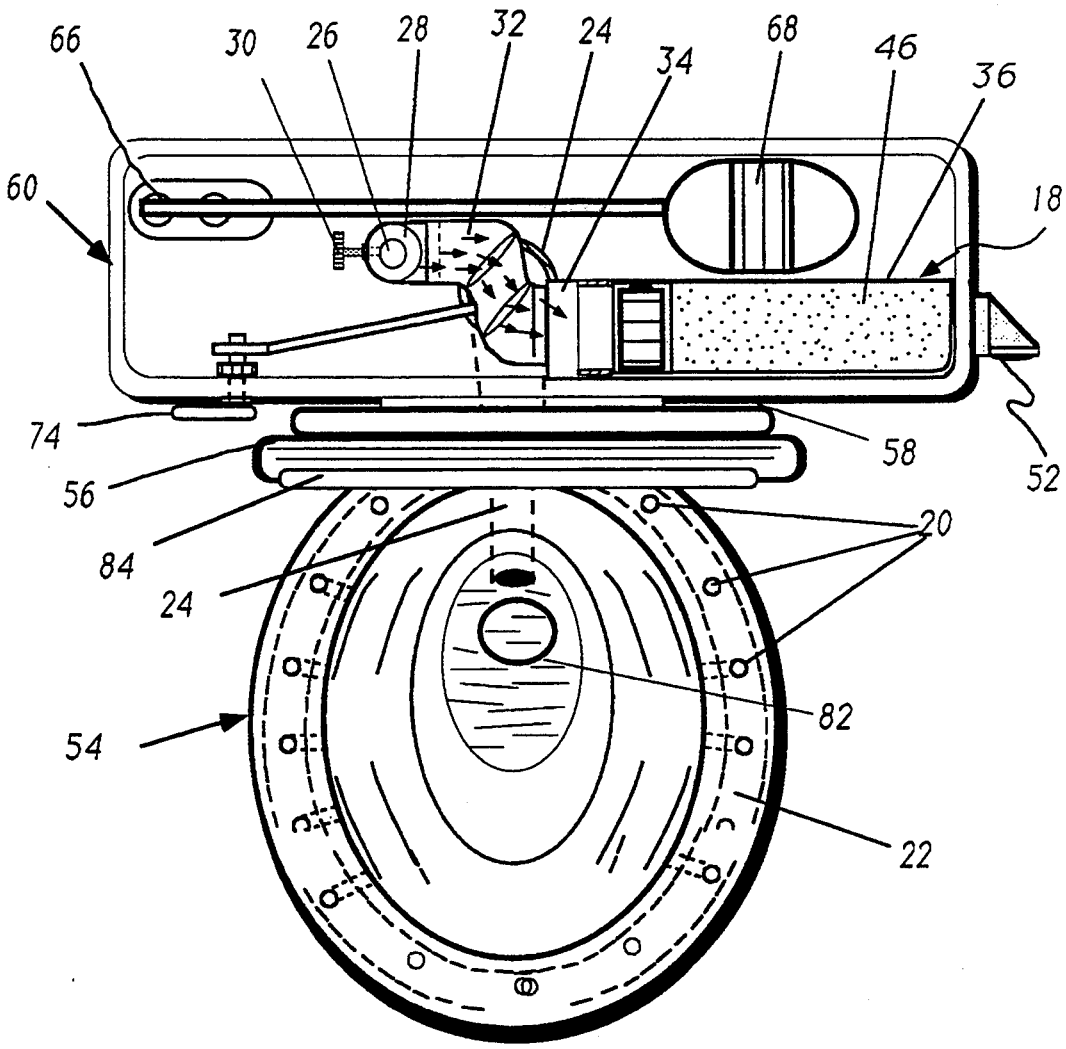
FIG. 1 is a top view of the flushing tank and bowl showing the internal structure of a typical flushing tank and the device located in an unused space.

| List of Reference Numerals: | |
|---|---|
| 18 | Malodorous filtering device |
| 20 | Orifices |
| 22 | Orifice cavity |
| 24 | Main flushing pipe |
| 26 | Overflow pipe |
| 28 | Water seal pipe |
| 30 | Screw |
| 32 | Flexible alignment pipe |
| 34 | Device air input pipe |
| 36 | Device housing |
| 38 | Cartridge guide |
| 40 | Cartridge |
| 42 | Air flow cavity |
| 44 | Cartridge housing |
| 46 | Filter |
| 48 | Battery |
| 50 | Motor blower |
| 52 | Motor control element |
| 54 | Commode bowl |
| 56 | Commode seat |
| 58 | Commode seat lid |
| 60 | Flushing tank |
| 62 | Flushing tank lid |
| 64 | Flushing valve |
| 66 | Tank filling valve |
| 68 | Float |
| 70 | Water supply pipe |
| 72 | Water cut off valve |
| 74 | Flushing handle |
| 76 | Flushing valve chain |
| 78 | Orifice cav sup opening |
| 80 | Outlet to sewage |
| 82 | Main flushing orifice |
| 84 | Auxiliary seat seal |
| 86 | Filling tube |
| 88 | Cartridge connector |
| 90 | Housing connector |
| 92 | Seat-bowl spacer |

DETAILED DESCRIPTION

Figure 2:
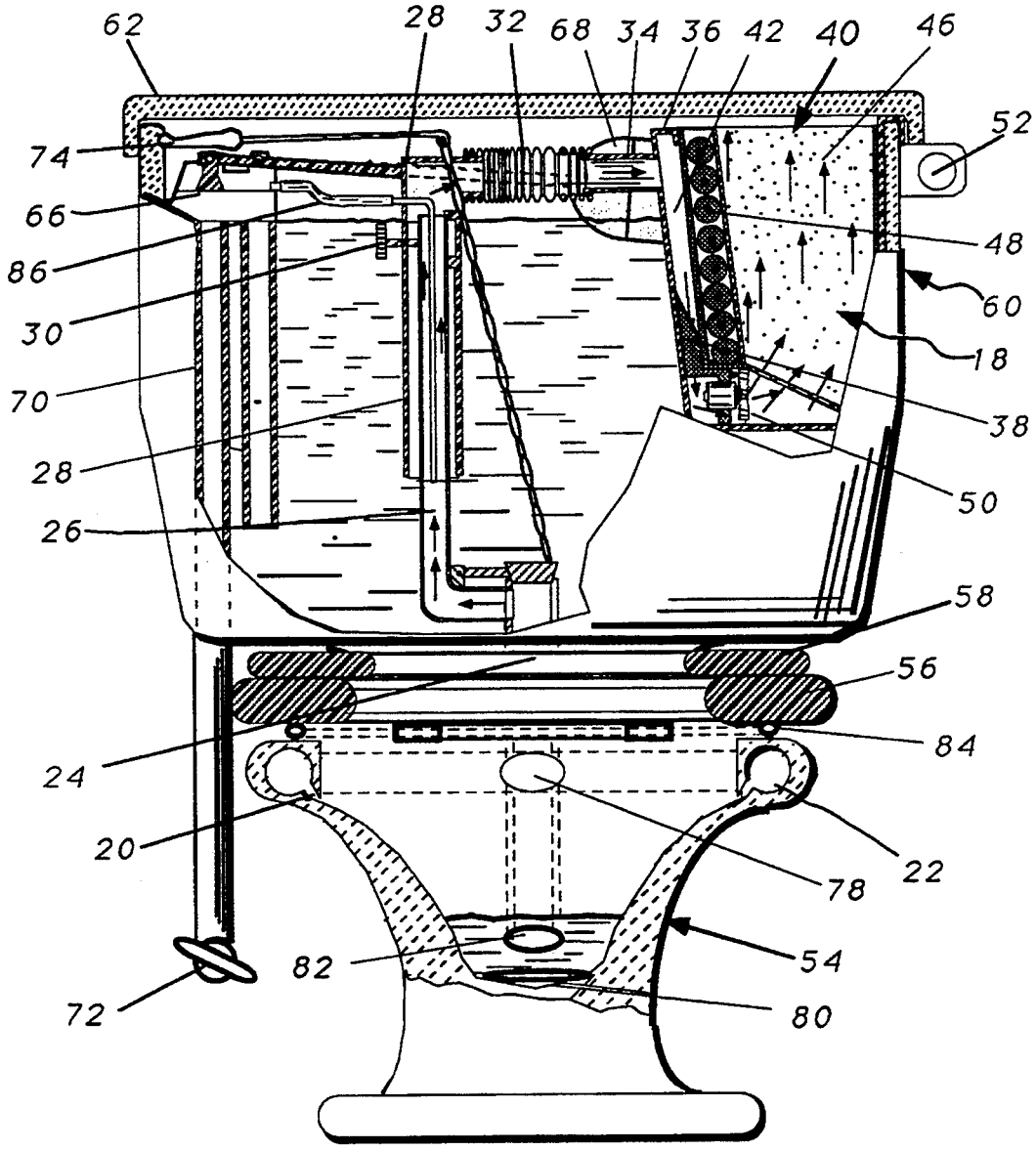
FIG. 2 is a cutaway front view of a commode tank and bowl, showing the internal structure of a typical flushing tank, bowl, seat-to-bowl seal and the device partially submerged.

FIG. 1, is a top view of a commode, showing the malodorous air entrapping device 18 positioned between the front wall of tank 60 and float 68 and mounted between the right end wall of tank 60 and overflow pipe 26. The device housing 36 is partially submerged and thus displaces an amount of water equal to the submerged volume. FIG. 2 shows tank filling pipe 70 and shutoff valve 72.

Referring to FIG. 2 of the illustrated embodiment, pipe 28 is of larger diameter than overflow pipe 26 and is connected to device 18 with interconnecting flexible hose 32. Space for the overflowing function is provided between overflow pipe 26 and pipe 28, while the water disposed between overflow pipe 26 and pipe 28 provides a low pressure air seal for drawing air from bowl 54. Auxiliary air seal 84 may be used between the seat 56 and bowl 54 to prevent excess leakage of air. After use, seat lid 58 is closed.

In the event of the failure of float valve 66 to close at the proper water level, the excess water flows upward between pipe 28 and overflow pipe 26, into overflow pipe 26 and is routed to the commode bowl through flushing pipe 24, orifice cavity 22, wash-down orifices 20 located underneath the rim of the commode bowl 54. In the embodiment shown in FIG. 2, pipe 28 is held in place by screw 30.

Figure 3:
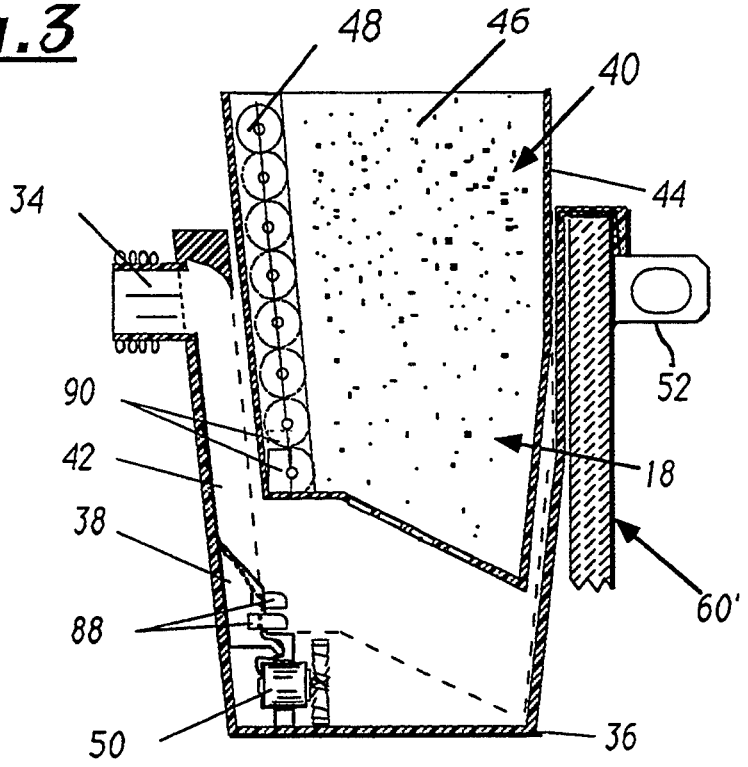
FIG. 3 is an enlargement of an embodiment of the device showing the housing of the device and blower, with the filter/battery cartridge partially inserted.

FIG. 3 shows cartridge 40 partially inserted in device housing 36. The dashed lines shows the operative position of cartridge 40. Air passageway 42 is formed between an end-wall of cartridge housing 44 and an end-wall of device housing 36.

In FIG. 3, it can be observed that before the insertion of the cartridge, the open end of the housing 36 provides easy access for the integration of blower 50 and guide 38 into housing 36 as well as providing easy access for servicing.

In FIG. 2, blower 50 draws the malodorous air from bowl 54, through rinsing or wash-down orifices 20, cavity 22, opening 78, flushing pipe 24, overflow pipe 26, water seal pipe 28, connecting hose 32, device housing air input pipe 34 and air passageway 42, (FIG. 3 and FIG. 4) formed by the space between a wall of device housing 36 and a wall of cartridge housing 44. From air passageway 42, blower 50 forces the malodorous air through filter 46, and with the malodorous elements of air removed, the air is exhausted into the bathroom through a small space between the flushing tank 60 (FIG.2), and the tank lid 62.

Filter 46, may be of the charcoal type which absorbs, or entraps, malodorous elements of air in the porous structure of the charcoal. The amount of the malodorous air element entrapment in such a filter is a function of the length of time, or period, during which the malodorous air molecules are exposed to the filter. The air-to-filter exposure time period, for effective entrapment, may be accomplished by filters of various designs. Effective filtering can be achieved with filters of a long and narrow cross-section design, that is, thin filters with a large exposure area, or thick filters with a small exposure area. If the filter area is decreased by one half, and the thickness is doubled, the velocity of the air through the filter can be doubled to achieve the same amount of filtering.

Figure 5:
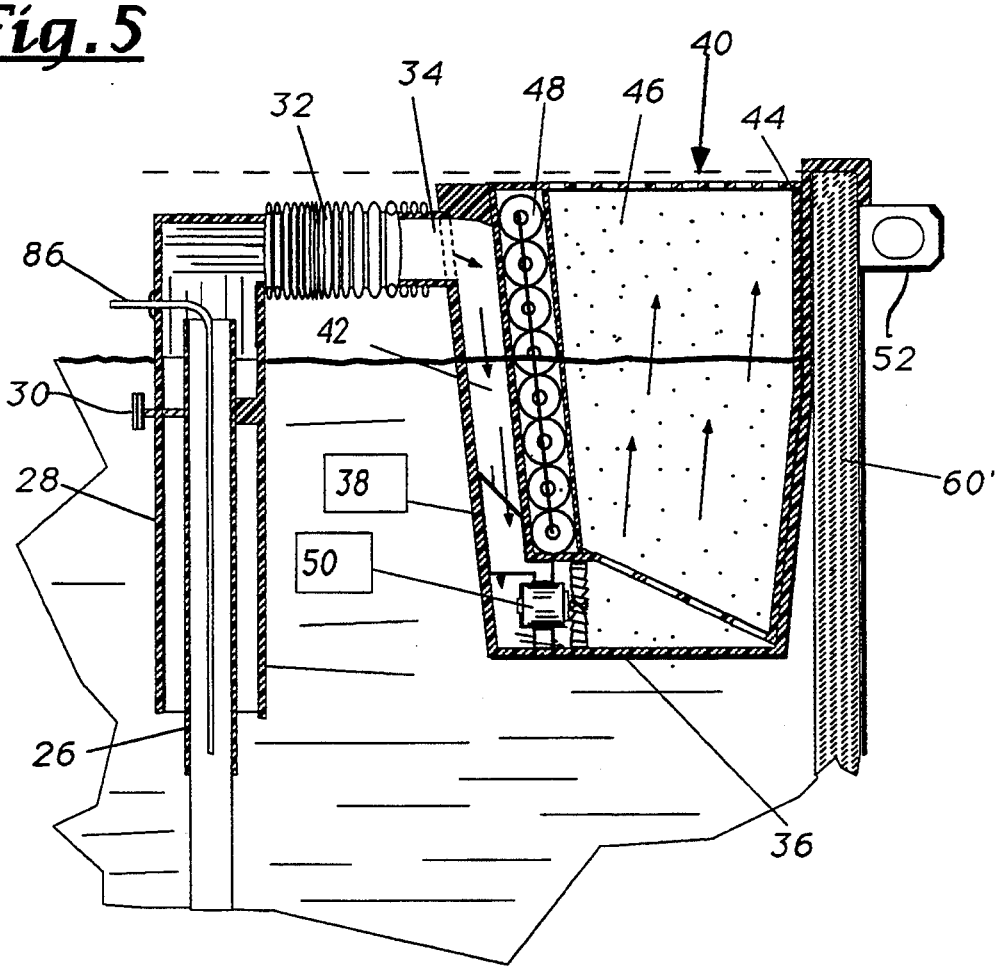
FIG. 5 is an enlarged fragmented front view of the device showing the housing of the device, a section of the overflow pipe, connecting pipes, blower, filter/battery cartridge, means for mounting said device on an end-wall and a motor control element.
Figure 6:
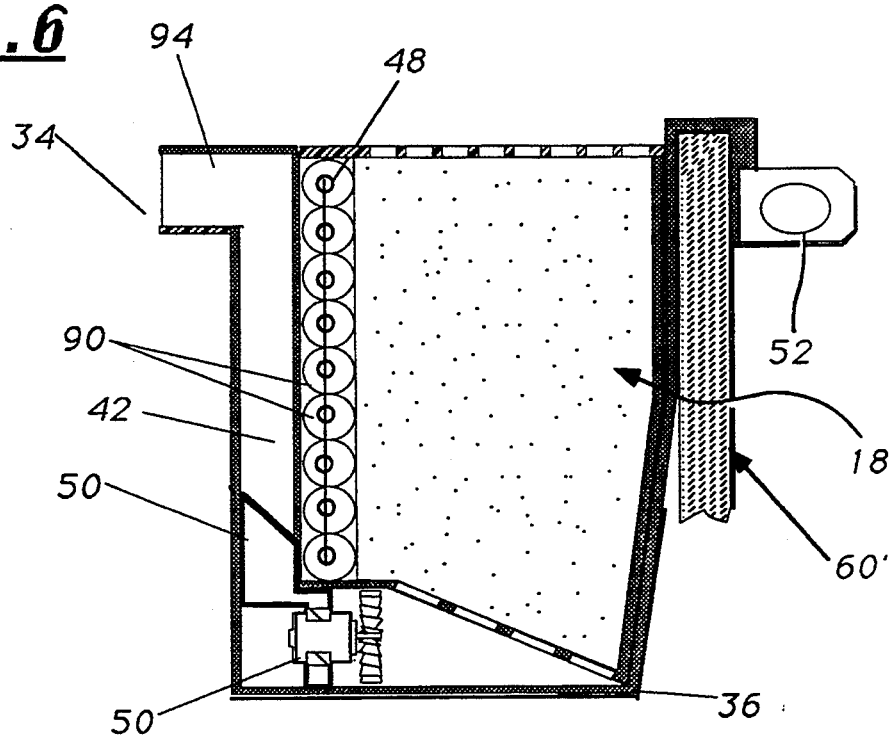
FIG. 6 shows an embodiment of the device and cartridge of another shape.

As can be seen in FIG. 1, the rectangular area seen in the top view of filter 46, represents the area of exposure, that is, a cross section of the area through which the air must pass. However, the distance through which the air must travel is the rather long path from blower 50 to the top of filter 46 as shown in FIG. 5. The effects of a relatively small cross-sectional exposure area is compensated by a relatively long distance through which the air must travel. Since the air travels through a greater distance than that of the thin filter type, the velocity of air through filter 46 can be higher, so that the effective removal of the malodorous elements of air is achieved.

In order to achieve residence of the device inside the flushing tank, the device must be specifically disposed within the available internal space configuration of prevailing flushing tanks; the filter must likewise conform to the available internal space or volume configuration of that allotted by the housing of the device.

The internal space configuration of prevailing flushing tanks imposes both the shape and size of device 18 disposed inside flushing tank 60; thus, filter 46, exhibits a column-like filter shape rather than a flat or thin filter shape with the air flow being in the direction of the largest dimension. The configuration and size of filter 46 allows its disposition within the internal space configuration of device 18, and in turn, the configuration and size of device 18 allows its disposition inside flushing tank 60.

On-off switches or timers may be used to activate the blower; however, in the embodiment shown in FIG. 5, an infrared sensing element 52 detects the presence of a user and provides a signal for activating a switch (not shown) for applying electrical power to the blower 50 for drawing malodorous air from bowl 54. When a user is no longer in proximity, the infrared sensor 52 detects the absence of a user and de-activates the blower 50.

Batteries and filters are known to have limited life and need replacement occasionally. As the filter/battery cartridge becomes less efficient with use, the cartridge is easily replaced by lifting off the tank lid 62, removing the used cartridge 40, inserting a new cartridge and replacing tank lid 62.

Figure 4:
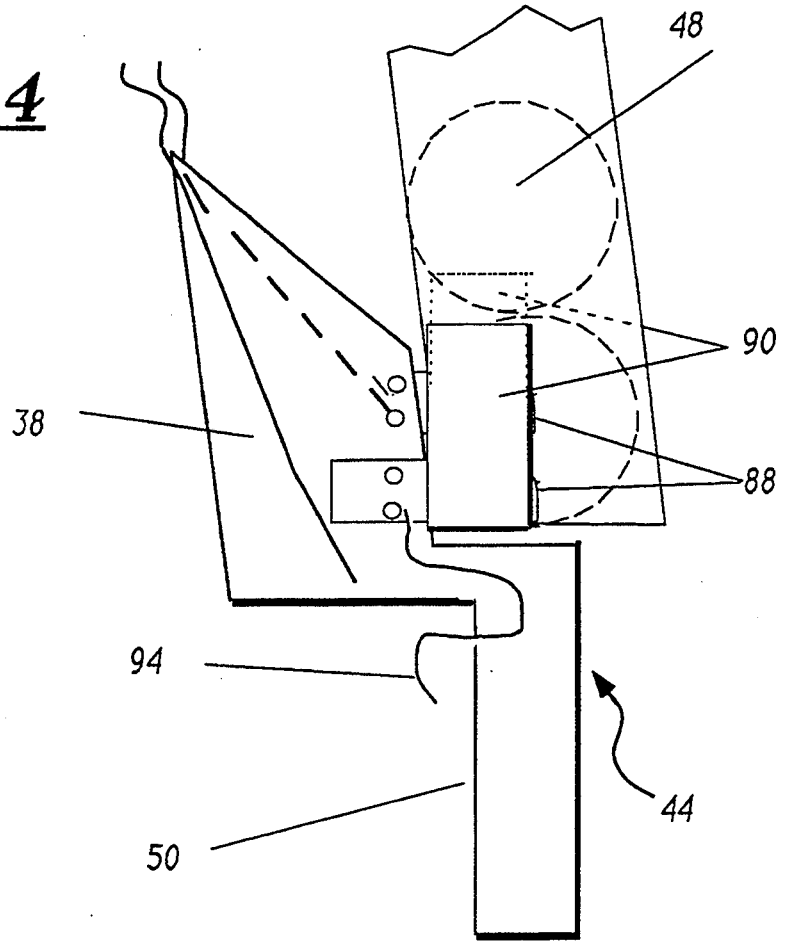
FIG. 4 is an enlarged front fragmented view of the preferred embodiment of the device showing cartridge guide and connector.

The separate replacement of the filter and the battery is avoided by the replacement of a single cartridge 40 containing a battery 48, filter 46, cartridge housing 44 and electrical connector 90 (FIG. 4). The electrical connections of battery 48 in the cartridge 40 to the blower motor 50 and the activating switch is accomplished during the insertion of cartridge 40. Cooperating, polarized connectors 88 and 90 (FIG. 4), mounted on both the cartridge guide 38 and the cartridge housing 44 respectively, are engaged by the insertion of cartridge 40 into housing 36.

There are two commonly used float designs for filling and maintaining a predetermined water level in prevailing flushing tanks. The configuration of the present invention is compatible with the internal space configuration which yields the least amount of space made available by either of the two prevailing float designs.

Figure 7:
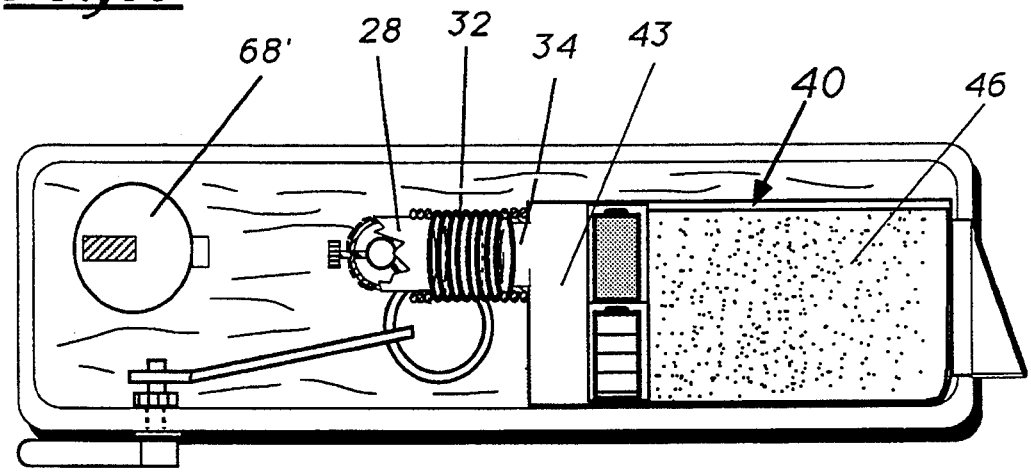
FIG. 7 shows another embodiment of the shape of the device wherein a different commercial flushing-tank filling-valve and float assembly is used.
Figure 8:
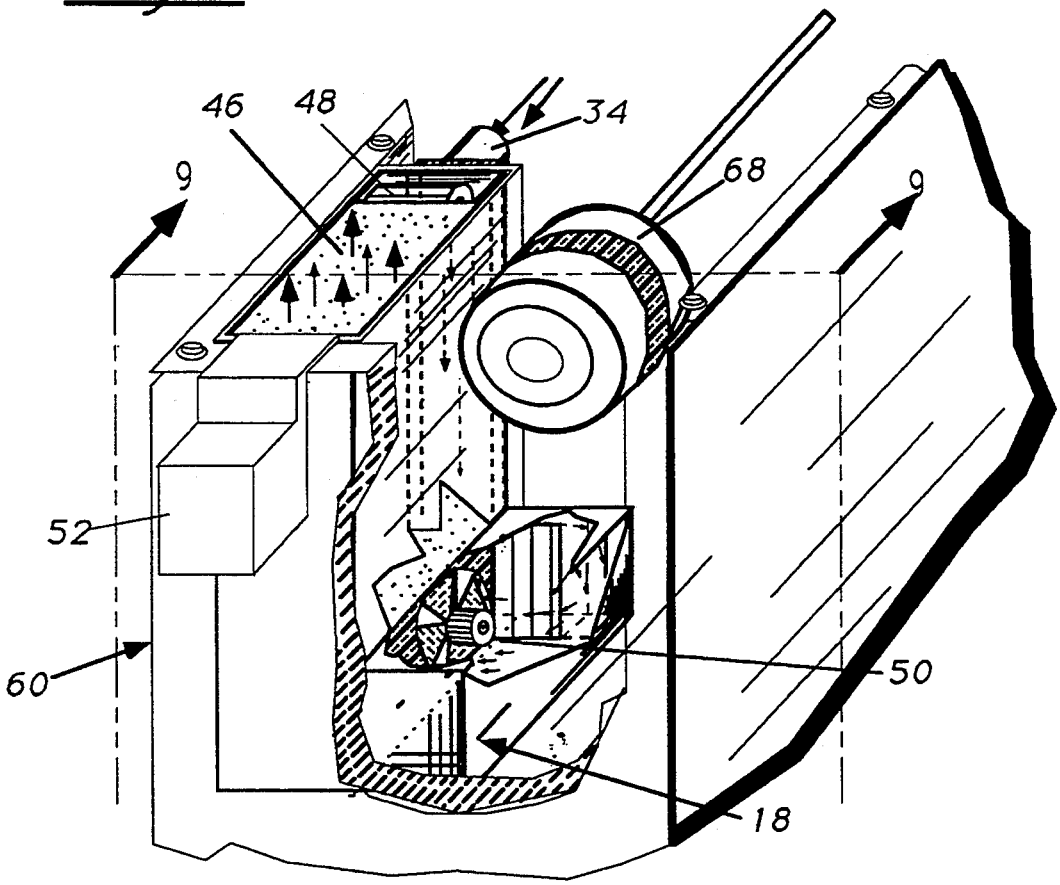
FIG. 8 is a perspective view of the invention, showing another embodiment, with an expanded lower section extending into an unused volume of the tank.
Figure 9:
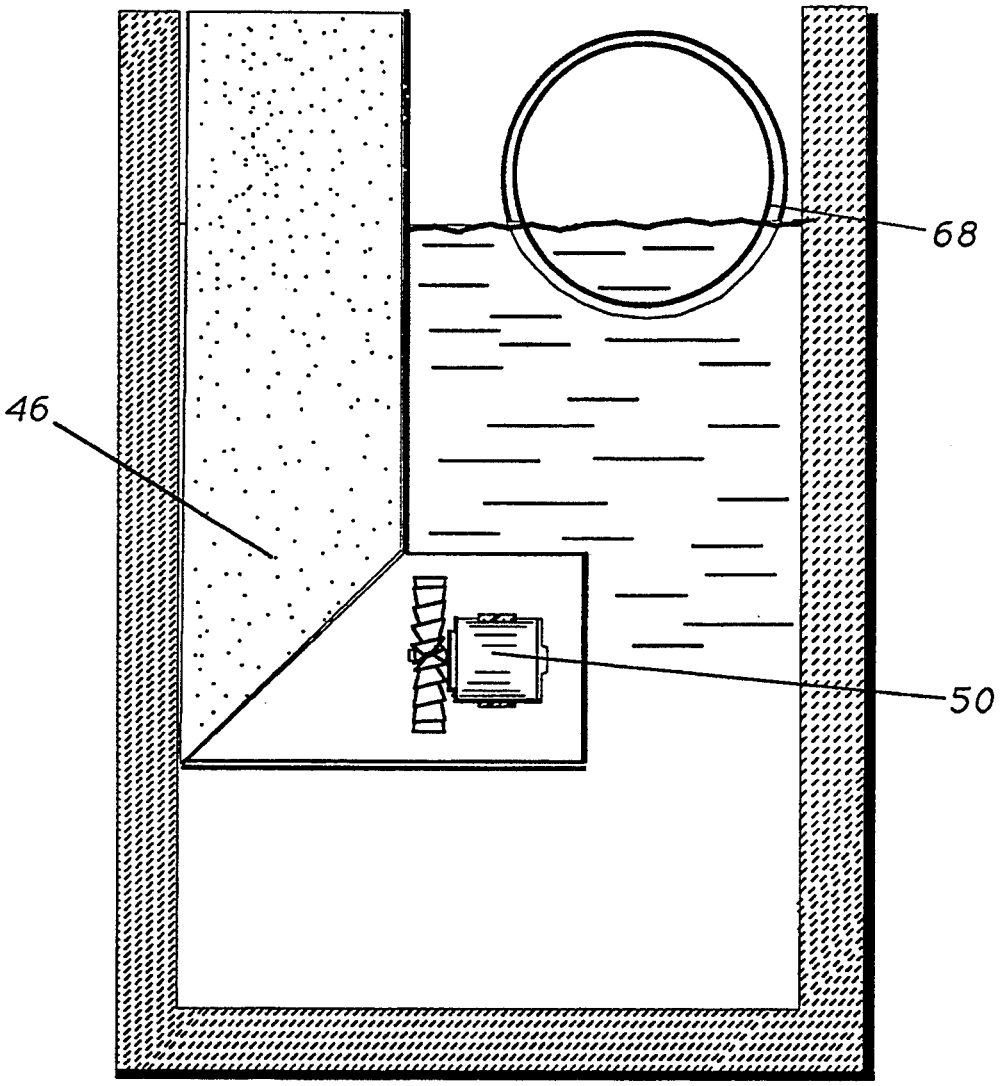
FIG. 9 is a section through 9—9 of FIG. 8 showing an "L" shaped device in which a portion is extended in a direction to occupy the unused space beneath the float.

FIG. 7 shows another embodiment of the shape of the device wherein a different commercial flushing tank filling valve and float assembly 68' is used. This valve and float assembly 68' design results in greater available internal tank space and thus provides the residence of a larger device. Advantage can be taken of the larger available space by increasing the size of battery and filter; thus, increasing the useable life of the device. However, the smaller device configuration is compatible with both the smaller and larger internal space configurations.

The presently preferred embodiment of the invention is in the form of a self-contained device for residence inside the flushing tank of a commercial commode; however, it is recognized that it is within the spirit of the invention for the functional elements of the device to be an integral part of an original commode design; in which case, it would not be a separate, self-contained device.

What 1 claim is:

1. A malodorous air removal device for use with a toilet, said toilet having a water tank, a bowl, an overflow pipe communicating between the tank and bowl, means for flushing the bowl with water from the tank, and for refilling the tank, and an air flow path extending between a top of said overflow pipe and said bowl, said malodorous air removal device comprising:

a main housing having an air inlet a bottom wall and a plurality of upstanding side walls extending from said bottom wall, a fan including an air path therethrough mounted in the vicinity of the bottom wall and at least one of said upstanding side walls, means to communicate air from the stand pipe to said air inlet, said main housing being of a size so as to be mounted in the water tank and having a waterproof portion which is submersed in tank water when in use, a cartridge housing including a battery, an air filter, a bottom wall and at least one upstanding side wall extending therefrom, said cartridge housing being adapted to be received in said main housing such that said at least one upstanding side wall of said cartridge housing will cooperate with said at least one of said upstanding side walls of said main housing so as to define an air passageway from said air inlet to said fan and said bottom wall of said cartridge housing will cooperate with said bottom wall of said main housing so as to provide an air passageway from said fan to said filter, said cartridge including means for electrically connecting said battery to said electrical fan, said main housing and said cartridge housing cooperating such that upon removal of said cartridge housing said fan is exposed for manual access.

2. Apparatus in accordance with claim 1, a proximity detector of the infrared sensor type for detecting the presence of the user when said user is positioned on said seat, said infrared sensor detects the presence of said user and produces a continuous signal to affect energizing said fan until said user rises from said seat at which time said user is no longer within the predetermined detection range of said infrared sensor, and under which condition, said continuous signal is discontinued, and said fan ceases to be energized.

3. Apparatus in accordance with claim 1, said means to communicate having an adjustable portion, said adjustable portion being adjustable in a plane substantially perpendicular to said overflow pipe.

4. Apparatus in accordance with claim 1 further characterized by the material of said air filter being of the activated charcoal type.

5. Apparatus in accordance with claim 1 further characterized by the material of said air filter being of the electrically generated ozone type.

* * * * *